US005664639A

United States Patent [19]

Worth

[11] Patent Number: 5,664,639

[45] Date of Patent: Sep. 9, 1997

[54] SAFETY DEVICE FOR A CHILD

[76] Inventor: Barbara Worth, 96-10 57th Ave. #9G, Corona, N.Y. 11368

[21] Appl. No.: 359,271

[22] Filed: Dec. 19, 1994

[51] Int. Cl.[6] ..... A62B 35/00

[52] U.S. Cl. ..... 182/3; 119/770

[58] Field of Search ..... 182/3–7, 9; 119/770

[56] References Cited

U.S. PATENT DOCUMENTS

| | | | |
|---|---|---|---|
| 284,434 | 9/1883 | Keech | 182/7 |
| 2,833,454 | 5/1958 | McGee | 182/3 |
| 2,979,028 | 4/1961 | Zakely | 244/151 R |
| 3,295,501 | 1/1967 | Riley | 119/770 |
| 3,458,188 | 7/1969 | Infante | 182/4 X |
| 3,487,474 | 1/1970 | De Meo | 182/3 |

*Primary Examiner*—Alvin C. Chin-Shue
*Attorney, Agent, or Firm*—Michael I. Kroll

[57] ABSTRACT

A safety device is provided for a child which consists of a first adjustable belt worn about a waist of the child, a second adjustable belt worn about a waist of an adult person and a structure for connecting the first adjustable belt to the second adjustable belt, so that the adult person will always have the child at their side, while keeping their hands free.

3 Claims, 2 Drawing Sheets

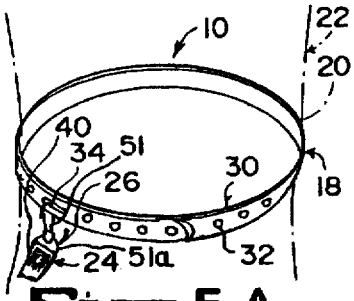
Fig. 5A
(ADJUSTABLE BELT i.e. PETITE TO LARGE)
Fig. 5
(ADJUSTABLE BELT-LARGE AS SHOWN, TO SMALL)
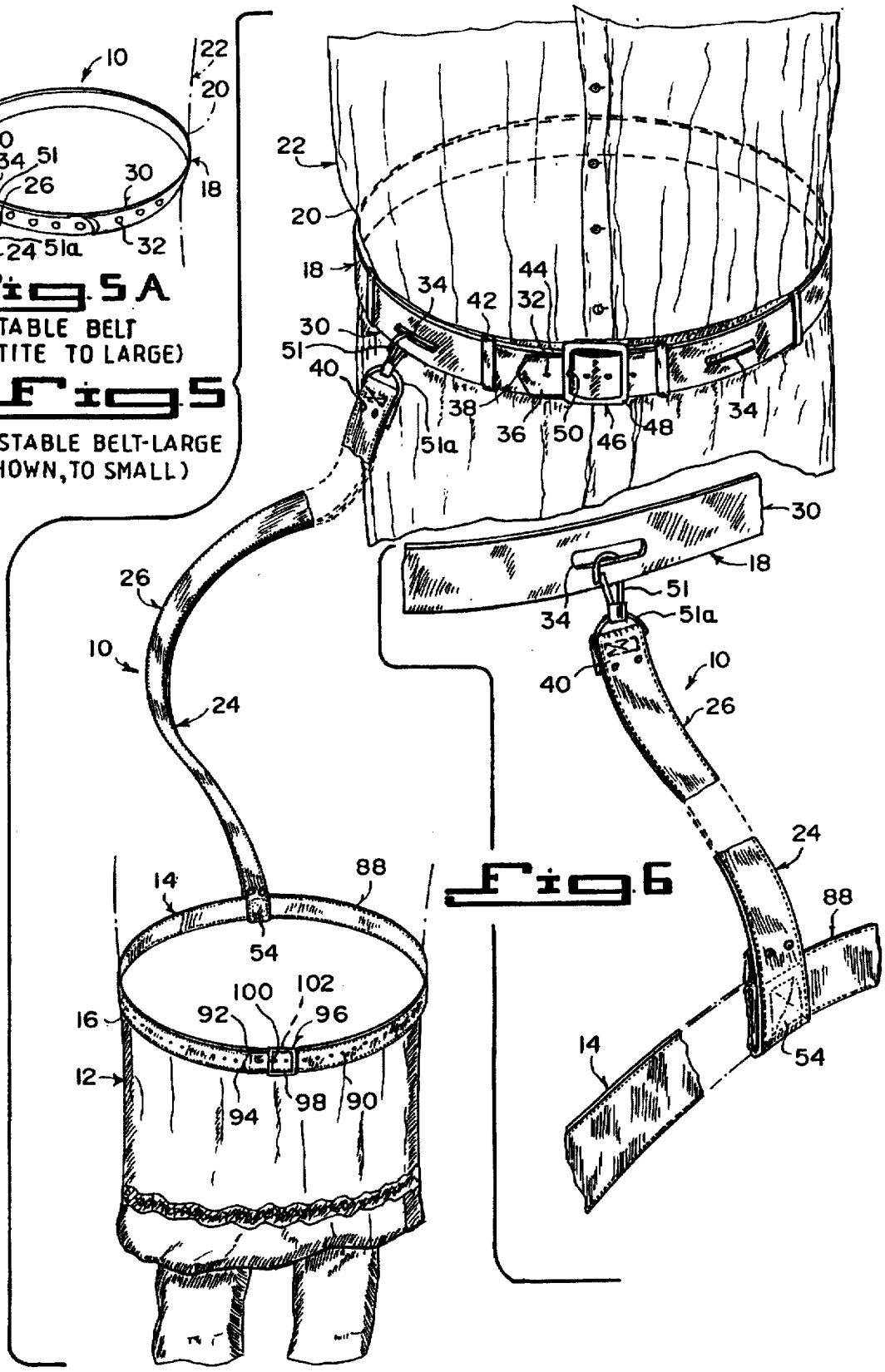
Fig. 6

SAFETY DEVICE FOR A CHILD

BACKGROUND OF THE INVENTION

1. Field of the Invention

The instant invention relates generally to children's harnesses and leashes and more specifically it relates to a safety device for a child.

2. Description of the Prior Art

Numerous children's harnesses and leashes have been provided in prior art that are adapted to retain children only when other people always hold onto the leashes by hand. If the leashes are released the children can run away. While these units may be suitable for the particular purpose to which they address, they would not be as suitable for the purposes of the present invention as heretofore described.

SUMMARY OF THE INVENTION

A primary object of the present invention is to provide a safety device for a child that will overcome the shortcomings of the prior art devices.

Another object is to provide a safety device for a child that will fasten a child securely to the side of an adult person for the purpose of keeping the child with the adult person at all times.

An additional object is to provide a safety device for a child in which an adjustable belt on the waist of the child is connected by a strap to an adjustable belt on the waist of the adult person, so that the hands of the adult person are free to do other things.

A further object is to provide a safety device for a child that is simple and easy to use.

A still further object is to provide a safety device for a child that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 5 is a perspective view of a second embodiment of the instant invention with parts broken away in use between a child and an adult person.

FIG. 5A is a diagrammatic perspective view of another type of adult belt used in the second embodiment.

FIG. 6 is a perspective view of a portion of the second embodiment showing the connector strap in greater detail.

DETAILED DESCRIPTION OF THE PREFERRED EMBODIMENTS

Figures 1, 2, 3, 4:
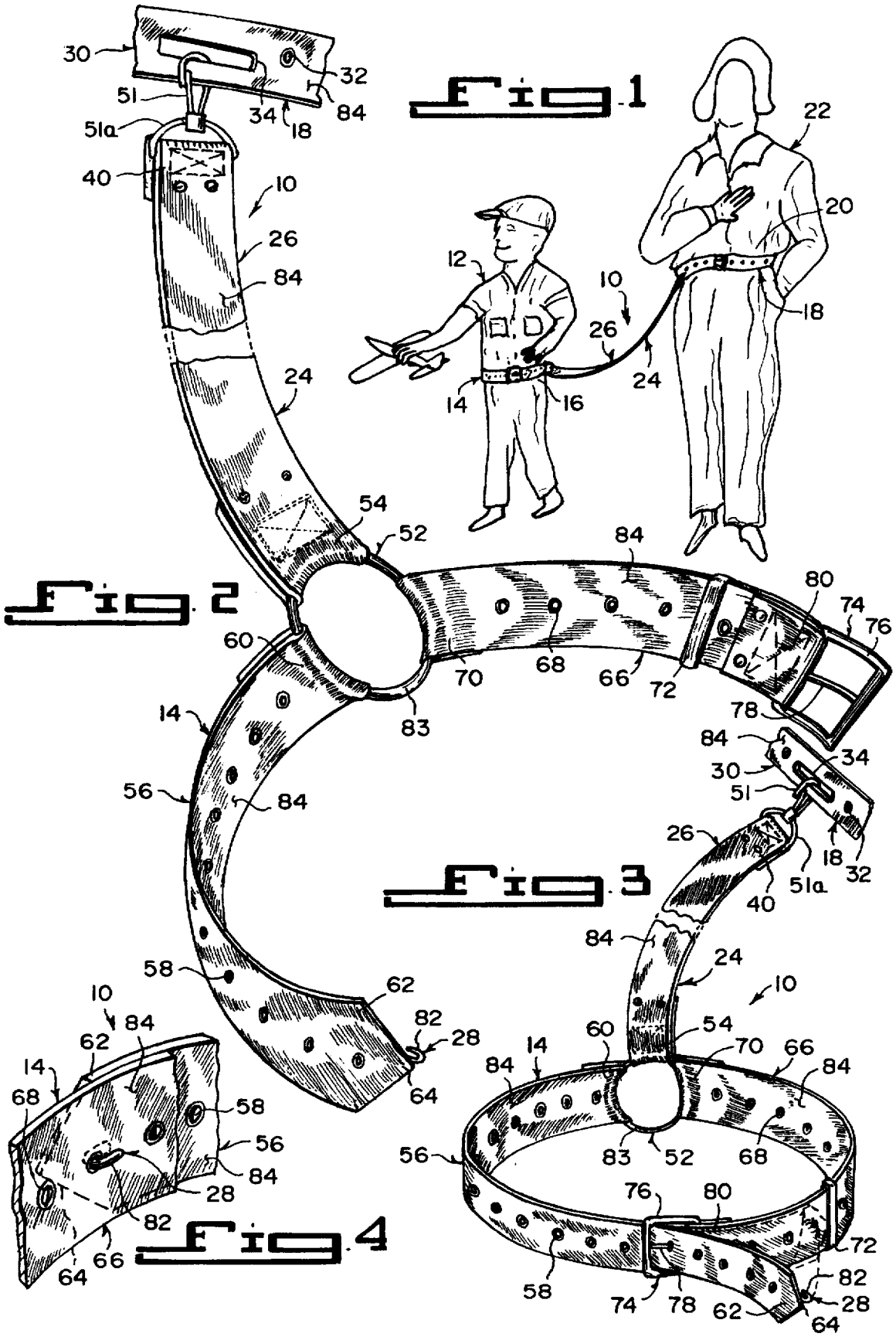
FIG. 1 is a perspective view of a first embodiment of the instant invention in use between a child and an adult person.
FIG. 2 is an enlarged perspective view of the first embodiment with parts broken away and the child's belt open.
FIG. 3 is a perspective view of the first embodiment with parts broken away and the child's belt closed.
FIG. 4 is a rear perspective view of a portion of the child's belt of the first embodiment showing the hook locked in place in one of the eyelets.

Turning now descriptively to the drawings, in which similar reference characters denote similar elements throughout the several views, FIGS. 1 through 6 illustrate a safety device 10 for a child 12 which consists of a first adjustable belt 14 worn about a waist 16 of the child 12. A second adjustable belt 18 is worn about a waist 20 of an adult person 22. A structure 24 is for connecting the first adjustable belt 14 to the second adjustable belt 18, so that the adult person 22 will always have the child 12 at their side, while keeping their hands free.

The connecting structure 24 is an elongated connector strap 26 extending between the first adjustable belt 14 and the second adjustable belt 18. The safety device 10, as best seen in FIGS. 2, 3 and 4, further includes a component 28 for locking the first adjustable belt 14 in place after the first adjustable belt 14 is positioned on the waist 16 of the child 12, so that the child 12 cannot easily open the first adjustable belt 14.

The second adjustable belt 18, as best seen in FIG. 5, includes a flexible panel member 30 having a plurality of laterally spaced apart eyelet holes 32 and at least one slot 34 with a first end 36 having a tip portion 38. A keeper 42 is connected to the panel member 30 near a second end 44 thereof. A buckle 46 having a frame 48 and a prong 50 is connected to the second end 44 of the panel member 30, so that the tip portion 38 can be inserted through the frame 48 with the prong 50 in engagement with one of the eyelet holes 32 in the panel member 30.

The connector strap 26 contains a clip 51 with a D-ring **51*a* connected to a first end 40 thereof. The clip 51 can be removably connected to the at least one slot 34**.

The first adjustable belt 14, as best seen in FIGS. 2 and 3, includes a retaining ring 52 connected to a second end 54 of the connector strap 26. A first flexible panel member 56 has a plurality of laterally spaced apart eyelet holes 58, and is connected at a first end 60 to the retaining ring 52 with a second end 62 having a tip portion 64. A second flexible panel member 66 has a plurality of laterally spaced apart eyelet holes 68 and is connected at a first end 70 to the retaining ring 52. A keeper 72 is connected to the second panel member 66. A buckle 74 having a frame 76 and a prong 78 is connected to a second end 80 of the second panel member 66, so that the tip portion 64 of the first panel member 56 can be inserted through the frame 76 with the prong 78 in engagement with one of the eyelet holes 58 in the first panel member 56.

The locking component 28 is a hook member 82 connected to the tip portion 64 of the first panel member 56, so that said hook member 82 can be inserted within one of the eyelet holes 68 in the second panel member 66, after the tip portion 64 is inserted through the frame 76 of the buckle 74.

The retaining ring 52 is fabricated out of a brass metal material 83. The first adjustable belt 14, the second adjustable belt 18 and the connector strap 26 are all fabricated out of webbing material 84, as shown in FIGS. 1 through 4.

The first adjustable belt 14, in FIGS. 5 and 6, is of another type and includes a flexible panel member 88 having a plurality of laterally spaced apart eyelet holes 90, with a first end 92 having a tip portion 94, so that the second end 54 of the connector strap 26 can be connected to the middle of the panel member 88.

A buckle having a frame 98 and a prong 100 is connected to a second end 102 of the panel member 88, so that the tip portion 94 can be inserted through the frame 98 with the prong 100 in engagement with one of the eyelet holes 90 in the panel member 88.

The drawings show the instant invention being used for one child 12 and an adult person 22. It can also be used in combination with two or more children or with animals, such as dogs and cats, which is not shown in the drawings. Also, there are other ways, not shown in the drawings, to adjust the first adjustable belt 14 and the second adjustable belt 18. These adjustment features can be incorporated within the scope of this invention.

LIST OF REFERENCE NUMBERS

10 safety device
12 child
14 first adjustable belt
16 waist of 12
18 second adjustable belt
20 waist of 22
22 adult person
24 connecting structure
26 elongated connector strap for 24
28 locking component
30 flexible panel member of 18
32 eyelet hole in 30
34 at least one slot in 30
36 first end of 30
38 tip portion on 36
40 first end of 26
42 keeper on 30
44 second end of 30
46 buckle on 44
48 frame of 46
50 prong of 46
51 clip
**51*a* D-ring on 40**
52 retaining ring of 14
54 second end of 26
56 first flexible panel member of 14
58 eyelet hole in 56
60 first end of 56
62 second end of 56
64 tip portion of 62
66 second flexible panel member of 14
68 eyelet hole in 66
70 first end of 66
72 keeper on 66
74 buckle on 80
76 frame of 74
78 prong of 74
80 second end of 66
82 hook member for 28
84 webbing material
88 flexible panel member for 14
90 eyelet hole in 88
92 first end of 88
94 tip portion on 92
96 buckle on 102
98 frame of 96
100 prong of 96
102 second end of 88

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A safety device for a child which comprises:

a) a first adjustable belt worn about a waist of the child;

b) a second adjustable belt worn about a waist of an adult person, said second adjustable belt including a flexible panel member having a plurality of laterally spaced apart eyelet holes and at least one slot with a first end having a tip portion, a keeper connected to said panel member near a second end thereof, and a buckle having a frame and a prong connected to said second end of said panel member, so that said tip portion can be inserted through said frame with said prong in engagement with one of said eyelet holes in said panel member;

c) means for connecting said first adjustable belt to said second adjustable belt, so that the adult person will always have the child at their side, while keeping their hands free, said connecting means including an elongated connector strap extending between said first adjustable belt and said second adjustable belt, said connector strap including a clip with a D-ring connected to a first end thereof, so that said clip can be removably connected to said at least one slot, said first adjustable belt including a retaining ring connected to a second end of said connector strap, a first flexible panel member having a plurality of laterally spaced apart eyelet holes and connected at a first end to said retaining ring with a second end having a tip portion, a second flexible panel member having a plurality of laterally spaced apart eyelet holes and connected at a first end to said retaining ring, a keeper connected to said second panel member, and a buckle having a frame and a prong connected to a second end of said second panel member, so that said tip portion of said first panel member can be inserted through said frame of said second panel with said prong in engagement with one of said eyelet holes in said first panel member; and d) means for locking said first adjustable belt in place after said first adjustable belt is positioned on the waist of the child, so that the child can not easily open said first adjustable belt, said locking means including a hook member connected to said tip portion of said first panel member, so that said hook member can be inserted within one of said eyelet holes in said second panel member, after said tip portion of said first panel is inserted through said frame of said buckle of said second panel.

2. A safety device for a child as recited in claim 1, wherein said retaining ring is fabricated out of a brass metal material.

3. A safety device for a child as recited in claim 2, wherein said first adjustable belt, said second adjustable belt and said connector strap are all fabricated out of webbing material.

* * * * *